United States Patent [19]

McTaggart et al.

[11] 4,199,736

[45] Apr. 22, 1980

[54] RF FUSE

[75] Inventors: James E. McTaggart, Malibu; Nuel C. Benson, Rancho Palos Verdes, both of Calif.

[73] Assignee: Eaton Corporation, Cleveland, Ohio

[21] Appl. No.: 873,622

[22] Filed: Jan. 30, 1978

[51] Int. Cl.[2] ..... H01P 1/10; H01P 1/22; H01P 3/06; H01R 19/48

[52] U.S. Cl. ..... 333/17 L; 324/110; 333/81 A; 333/260; 339/126 J; 361/119

[58] Field of Search ..... 333/17 L, 97 R, 17 R, 333/81 A, 81 R, 245–248, 254–257, 260; 361/119; 339/111, 126 J, 147 R, 150 F, 222, 252 F, 253 F, 270 F; 324/110; 337/221

[56] References Cited

U.S. PATENT DOCUMENTS

| | | | |
|---|---|---|---|
| 2,886,744 | 5/1959 | McNatt, Jr. | 361/119 |
| 3,187,224 | 6/1965 | Massena | 324/110 |
| 3,226,661 | 12/1965 | Garver et al. | 333/17 L |
| 3,711,794 | 1/1973 | Tasca et al. | 333/81 A |
| 3,777,219 | 12/1973 | Winters | 333/97 R |

*Primary Examiner*—Marvin L. Nussbaum
*Attorney, Agent, or Firm*—Kevin Redmond

[57] ABSTRACT

An RF connector has an overrated fuse located therein which is electrically connected in series with the center conductor. An overrated fuse is utilized because a fuse rated to give the desired protection is undesirable due to the resistance caused by its small diameter. To obtain the desired protection with the overrated fuse, current shunting means, such as diodes, are mounted within the RF connector and are electrically connected between the outer and inner conductors. The current shunting means are positioned within the RF connector to present minimum inductance to the RF circuit. The operation of the fused RF connector is such that when the power applied to the connector exceeds a predetermined amount, the current shunting means conduct the excess current to ground to provide protection to the associated equipment until the input power is sufficient to blow the overrated fuse.

3 Claims, 11 Drawing Figures

RF FUSE

BACKGROUND OF THE INVENTION

This invention relates to RF (radio frequency) fuses and more particularly to RF fuses that are contained within an RF connector.

It is known to protect various RF equipment, such as, RF instrumentation apparatus, from excessive RF power by the use of fuses. It is also known to locate or mount the fuseable element into RF connectors that are utilized in conjunction with the RF apparatus to be protected. A problem is encountered, however, when the RF apparatus is to be protected from relative small amounts of RF power. For example, as the power level which blows the fuse is decreased, the diameter of the rated fuseable element also decreases. The small diameter fuseable element, however, presents a high resistance to radio frequencies thereby creating undesirable voltage standing wave ratios. In accordance with one feature of the present invention, the desired protection is obtained by using an overrated fuse in conjunction with current shunting means that shunt excess currents to ground until the applied power causes the fuse to blow.

Accordingly, one object of this invention is to provide an improved RF fuse.

Another object of this invention is to provide a fused RF connector which utilizes an overrated fusing element to eliminate the undesirable characteristics associated with small diameter fuseable elements.

A further object of this invention is to provide a fused RF connector which utilizes current shunting means to enable an overrated fuseable element to be incorporated therein.

Still another object of this invention is to provide a fused RF connector which utilizes current shunting diodes to enable an overrated fuseable element to be incorporated therein.

An additional object of this invention is to provide a fused RF connector having current shunting diodes mounted within the dielectric material in such a manner as to present minimum impedance to excess currents resulting from RF overload.

BRIEF SUMMARY OF THE INVENTION

These and other objects, features and advantages of the present invention are obtained in an RF connector that comprises a center conductor portion and an outer conductor portion surrounding the center conductor portion and having its longitudinal axis substantially parallel to the longitudinal axis of the center conductor. A dielectric material is interposed between the center and outer conductor portions and includes four openings extending therethrough from one end thereof to the other end thereof. The openings have a longitudinal axis that is substantially parallel to the inner conductor. A first diode is located within one opening and has its anode lead extending from the one end and its cathode extending from the other end. A second diode is located in another opening and has its anode lead extending from the one end. The cathode lead of the first diode is electrically coupled to the center conductor of the RF connector while the anode lead of the second diode is electrically coupled to the outer conductor of the RF connector. The cathode lead of the second diode and the anode lead of the first diode are electrically connected to one another. A third diode is located within a remaining opening and has its anode lead extending from the other end and its cathode lead extending from the one end. A fourth diode is located within the one remaining opening and has its cathode lead extending from the other end and its anode lead extending from the one end. The anode lead of the third diode is electrically coupled to the center conductor while the cathode lead of the fourth diode is electrically coupled to the outer conductor. The cathode lead of the third diode and the anode lead of the fourth diode are electrically coupled to one another. An overrated current sensitive interrupting means is located in the RF connector and is connected electrically in series with the inner conductor.

BRIEF DESCRIPTION OF THE DRAWINGS

The present invention will be readily understood from the following detailed description taken in conjunction with the drawings described below and wherein like reference characters denote like or corresponding parts throughout the several views.

DESCRIPTION OF THE PREFERRED EMBODIMENT

Figure 1:
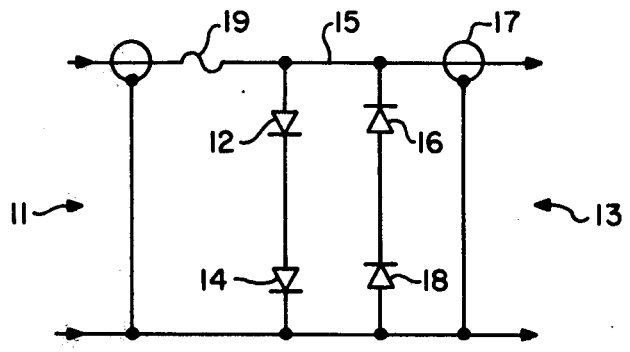
FIG. 1 is a schematic illustration of a fused RF connector in accordance with the present invention.

A fused RF connector in accordance with the present invention is schematically illustrated in FIG. 1 and includes an input portion 11 and an output portion 13. An outer conductor 17 surrounds an inner conductor 15 which has a fuseable link 19 connected in series therewith. In accordance with one embodiment of the present invention which was constructed the fuseable element 19 constituted a 0.125 amp pico fuse manufactured by Littelfuse Incorporated and was utilized with a 50 ohm RF connector. The 0.125 amp fuse 19 will blow at approximately 0.8 watts or 6.25 volts. These power and voltage levels, however, are too high for many RF applications. However, the use of a properly rated fuseable element 19 introduces resistance into the RF circuit due to the small diameter of the fuseable element 19. Such resistance produces undesirable electrical characteristics such as an undesirable voltage standing wave ratio. In order to obtain the desired protection, current shunting means 12, 14, 16 and 18 are connected between the inner 15 and outer 17 conductors. In the specific embodiment described herein, protection was obtained from RF power levels in excess of about 0.1 watts. As shown in FIG. 1, a first 12 and second 14 diode are connected between the center 15 and outer 17 conductors while a third 16 and fourth 18 diode are connected between the center 15 and outer 17 conductors. The cathode of the first diode 12 is connected to the center conductor 15 while its anode is connected to the cathode of the second diode 14 which has its anode connected to the outer conductor 17. The anode of the third diode 16 is connected to the center conductor 15 while its cathode is connected to the anode of the fourth diode 18 which has its cathode connected to the outer conductor 17. In accordance with one embodiment of the present invention which was constructed the diodes 12, 14, 16 and 18 constituted 1 N 4149 silicon type diodes. As is well known, silicon diodes will normally conduct when the forward voltage thereacross is approximately 0.6 volts. By placing two such diodes in series, the doides will not conduct until the voltage thereacross is about 1.2 volts. Accordingly, a DC voltage of 1.2 volts or greater of positive potential on the center conductor 15 will cause diodes 16 and 18 to conduct whereas the same voltage of opposite polarity on the center conductor 15 will cause diodes 12 and 14 to conduct. In like manner an instantaneous radio frequency potential of 1.2 volts peak or greater which is positive will cause doides 16 and 18 to conduct while a similar instantaneous RF potential of opposite polarity will cause diodes 12 and 14 to conduct.

Briefly described, the operation of the fused RF connector shown in FIG. 1 is such that at low power levels the power output obtained therefrom is substantially equal to the power applied thereto. As the input power increases, however, the diodes 12, 14, 16 and 18 will conduct to shunt excess currents to ground to protect the associated equipment (not shown). This continues until the input power applied to the RF connector causes the overrated fuse 19 to blow.

Figure 2:
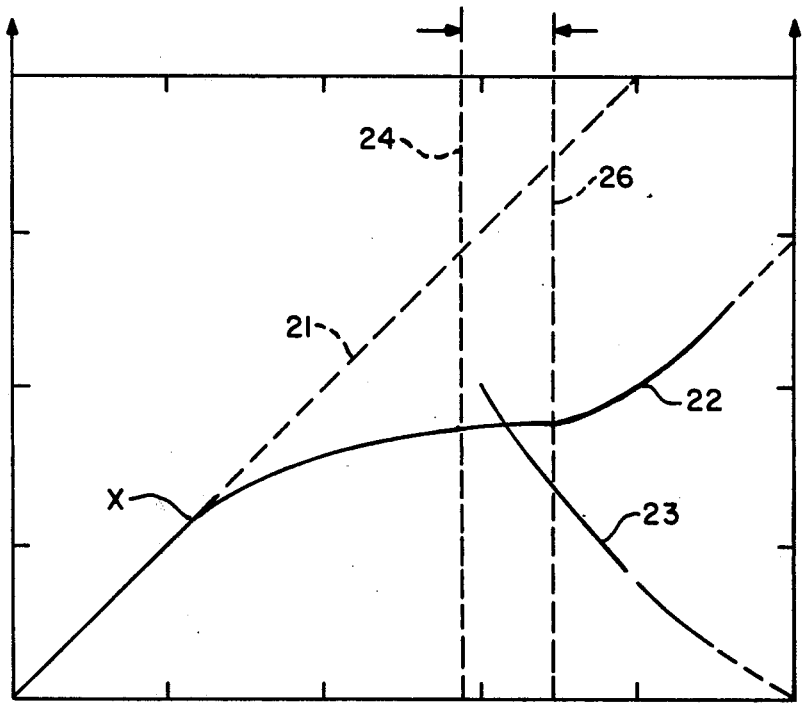
FIG. 2 illustrates various curves that show the operational characteristics of the fused RF connector in accordance with the present invention.

The RF connector in accordance with the present invention will be readily understood by a perusal of FIGS. 1 and 2. In FIG. 2 the horizontal coordinate is input power, the left hand vertical coordinate is output power and the right hand vertical coordinate is time in milli seconds. The curves shown in FIG. 2 represent the operational characteristics when the specific components described hereinabove are utilized. The dotted line 21 shows the relationship between power obtained from the RF connector with respect to power applied to the RF connector in the absence of the fuse 19 and diodes 12, 14, 16 and 18. The solid curve 22 shows the relationship between power applied to the RF connector and the power obtained from the RF connector when the fuse 19 and diodes 12, 14, 16 and 18 are utilized in accordance with the present invention. The solid curve 23 indicates the time required for the fuse 19 to create an open circuit once sufficient power has been applied to the fuse 19.

As shown by the curve 22 in FIG. 2, the output power from the fused RF connector equals the input power until the point X is reached which is above a power level of 0.01 watts and below a power level of 0.1 watts. At this point the peak voltage on the center conductor 15 is such that the diodes 12 and 14 and the diodes 16 and 18 become conducting on alternate half cycles of RF energy. Beyond the point X the output power will continue to increase as the input power is increased but at a much slower rate due to the conduction of the diodes 12, 14, 16 and 18. The space between the dotted line 21 and the solid curve 22 illustrates the energy that is shunted to ground by the diodes 12, 14, 16 and 18 to protect the equipment associated with the fused RF connector. As shown by the vertical dotted lines 24 and 26, the fuse 19 will blow when the power applied to the RF connector is between 0.8 and 3 watts. Once the power required to blow the fuse 19 has been applied, a finite time is required for the fuseable element 19 to actually separate and create an open circuit. As shown by the solid line 23, the fusing time delay of the fuseable element 19 is inversely proportional to the power applied to the RF connector. The characteristics illustrated in FIG. 2 are obtained for a RF connector constructed in accordance with the present invention for a frequency operating range of from zero to about one giga hertz. As will be apparent to those skilled in the art, the fused connector can provide protection for power applied at the output 13 by connecting another fuse (not shown) in series with the fuse 19 with the diodes 12, 14, 16 and 18 being connected between the junction of the two fuses and the outer conductor 17.

Figure 3A:
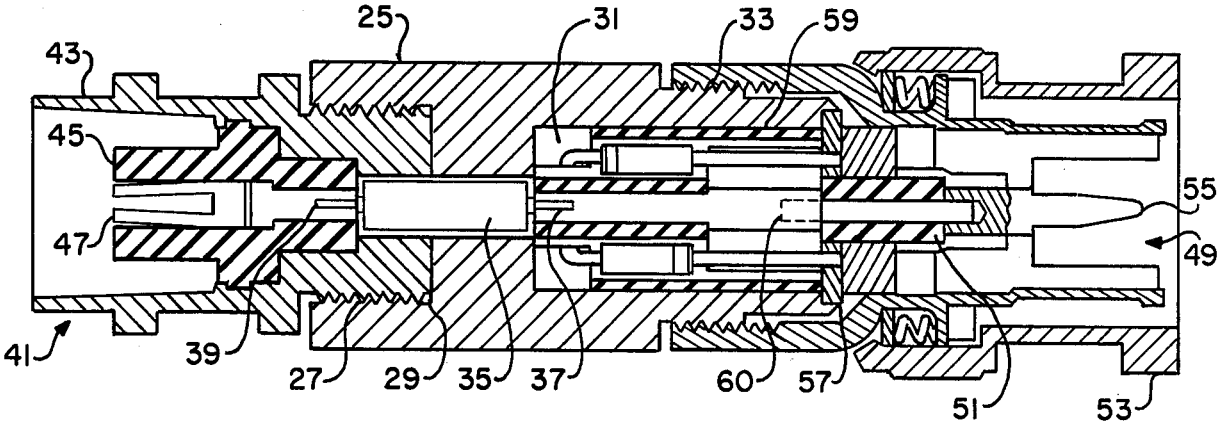
FIGS. 3A, 3B and 3C are cross sectional and plan views of an in line RF connector in accordance with the present invention.
Figure 3B:
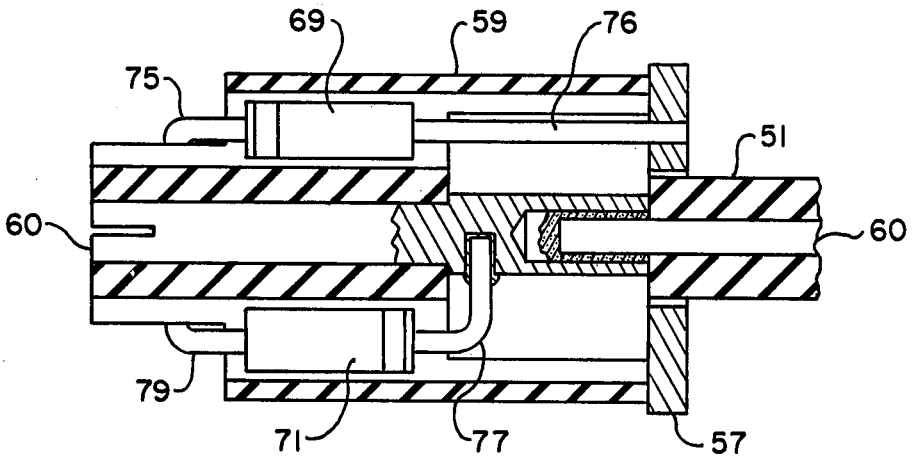
Figure 3C:
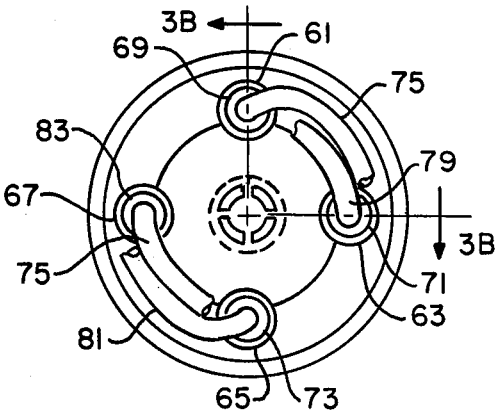

An inline RF connector in accordance with the present invention is illustrated in FIGS. 3A, 3B and 3C as including an outer conductor 25 portion. A first annular opening 29 is located at one end of the outer conductor 25 while a second annular opening 31 is located at the other end of the outer conductor 25. The outer conductor 25 includes a reduced diameter portion intermediate the annular openings 29 and 31. A fuse 35 having leads 37 and 39 extending from opposite ends thereof is surrounded by the reduced diameter area of the outer conductor 25. The exterior body of the fuse 35 typically consist of an insulating material (not shown) which electrically isolates the fuse 35 from the outer conductor 25. The internal wall 27 of the annular opening 29 is threaded to threadably receive a standard type BNC coaxial connector 41 which includes a outer conductor 43 electrically connected to the outer conductor portion 25 and a center conductor 47 which is insulated from the outer conductor 43 by a dielectric material 45. One end of the center conductor 47 slidably receives the lead 39 of the fuse 35. The exterior surface at the other end of the outer conductor 25 adjacent to the annular opening 31 is threaded to threadably receive another standard type BNC coaxial connector 49 which includes an outer conductor 53 which is electrically connected to the outer conductor portion 25. The connector 49 also includes a center conductor 55 which is insulated from the outer conductor 53 by a dielectric material 51. The lead 37 of the fuse 35 is serially connected to the center conductor 55 of the coaxial connector 49 by a conductor 60. The lead 37 of the fuse 35 slidably engages the end of the center conductor 60 adjacent thereto. As will now be apparent, the outer conductor portion 25 and the outer conductor 53 of the coaxial connector 49 are electrically connected together to form the outer conductor for the complete connector assembly. In a like manner the center conductor 47 of the coaxial connector 41, the fuse element 35, the conductor 60, and the center conductor 55 of the coaxial connector 49 constitute the center conductor portion for the complete connector assembly and is electrically insulated from the outer conductor portion of the complete connector assembly.

Located within the annular opening 31 and surrounding the center conductor 60 is an annular piece of dielectric material 59, such as nylon. As best shown in FIGS. 3B and 3C, first, second, third and fourth substantially equally spaced openings 61, 63, 65 and 67, respectively, extend through the dielectric material 59. As shown, the longitudinal axis of these openings 61, 63, 65 and 67 are substantially parallel to the longitudinal axis of the outer 25 and inner 60 conductors. A metallic washer 57 is secured to one end of the outer conductor 25 and is electrically insulated from the center conductor 60 by the dielectric material 51 and functions to retain the dielectric material 59 within the annular opening 31. A diode 69 is located within the first opening 61 and has its cathode terminal 76 connected to the outer conductor 25 by being connected to the washer 57 by any suitable means such as by soldering. A diode 71 is located within the second opening 63 and has its anode terminal 77 connected to the center conductor 60 by any suitable means such as by soldering. The anode lead 75 of the diode 69 and the cathode lead 79 of the diode 71 extend from the same end of the dielectric material 59 and are electrically connected together by any suitable means such as soldering. In like manner a diode 73 is located within the third opening 65 and has its anode lead (not shown) connected to the outer conductor 25 by being electrically connected to the washer 57. A diode 83 is located within the fourth opening 67 and has its cathode lead (not shown) connected to the center conductor 60. The cathode lead 81 of the diode 73 and the anode lead 75 of the diode 83 extend from the same end of the dielectric material 59 and are electrically connected together. Input power is applied to the left side of the RF connector by way of the coaxial connector 41 and output power is obtained from the right side of the RF connector by way of the coaxial connector 49.

As will be apparent from a perusal of FIGS. 3B and 3C the placement of the diodes 69, 71, 73 and 83 and the electrical connection of the diodes 69, 71, 73 and 83 with the inner 60 and outer 25 conductors is such that the diode 69, 71, 73 and 83 leads are kept short thereby presenting minimum impedance to excess currents resulting from RF overload. A spent fuse 35 is replaced merely by disengaging the coaxial connector 41 from the outer conductor portion 25, removing the spent fuse 35 and reinserting a new fuse 35, and then again threadably engaging the coaxial connector 41 with the outer conductor 25. The electrical circuit of the fused RF connector illustrated in FIGS. 3A, 3B and 3C is substantially identical to that shown in FIG. 1 and described hereinabove in conjunction with FIG. 2.

Figure 4A:
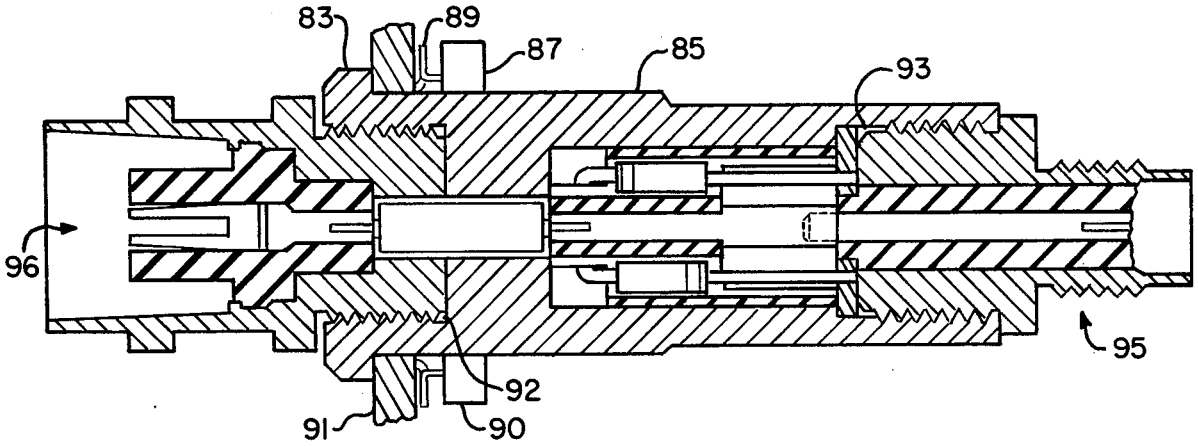
FIGS. 4A, 4B and 4C are cross sectional and plan views of a panel mounted, fused RF connector in accordance with the present invention.
Figure 4B:
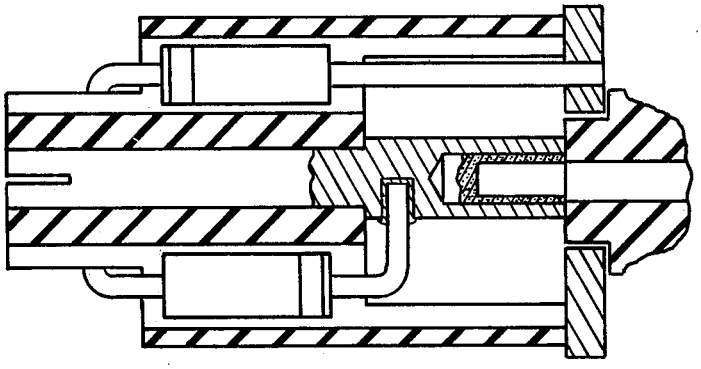
Figure 4C:
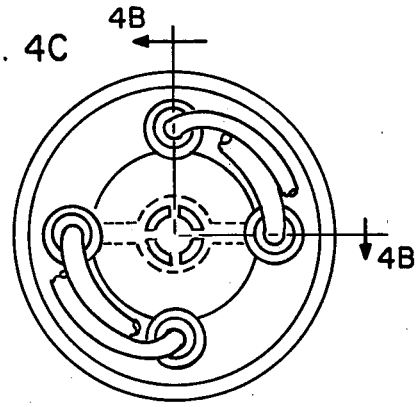
Figure 5:
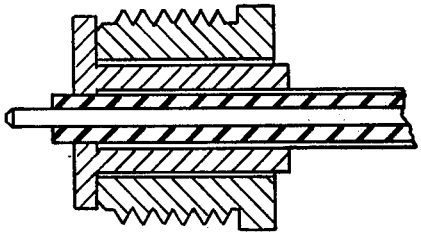
FIGS. 5, 6 and 7 are cross sectional illustrations of various coaxial connections which may be utilized with the RF connector shown in FIGS. 4A, 4B and 4C.
Figure 6:
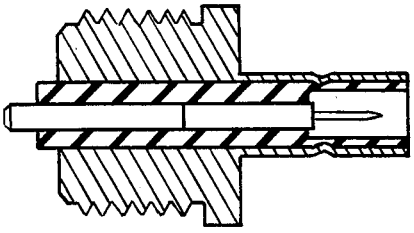
Figure 7:
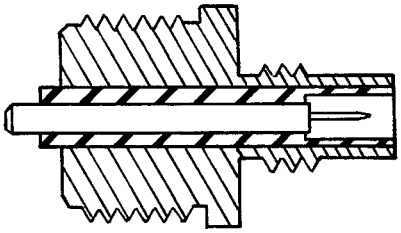

A panel mounted fused RF connector in accordance with the present invention is illustrated in FIGS. 4A, 4B and 4C. As shown in FIG. 4A the exterior surface of the outer conductor portion 90 adjacent to the annular opening 92 contains a flanged or shoulder portion 83 adjacent to a threaded area 85. The shoulder portion 83 and threaded area 85 enable a hex nut 87 and washer 89 to be utilized to secure the fused RF connector to a panel member 91. Additionally, a portion of the internal walls of the annular opening 93 adjacent the other end of the outer conductor 90 are threaded to enable a standard type SMA coaxial connector 95 to be threadably secured to the right-hand portion of the outer conductor portion 90. In other respects, the panel mounted RF connector illustrated in FIGS. 4A and 4B and 4C is substantially identical to the fused in line RF connector illustrated in FIGS. 3A, 3B and 3C. FIG. 4A shows a standard type SMA coaxial connector 95 threadably secured to the right-hand portion of the outer conductor 90. It is to be understood, however, that the present invention is not limited to this type of connector. For example, the semi rigid coaxial connector illustrated in FIG. 5 as well as the SMB type coaxial connector illustrated in FIG. 6 and the standard type SMC coaxial connector illustrated in FIG. 7 may be utilized in lieu of the SMA type coaxial connector. Additionally, the inline RF connector illustrated in FIGS. 3A, 3B and 3C and the panel mounted RF connector illustrated in FIGS. 4A, 4B and 4C can be fitted at one or both ends with a standard type N coaxial connector (now shown) or with any combination of the coaxial connectors described herein. As in the case of the inline RF connector, the input to the RF connector illustrated in FIGS. 4A, 4B and 4C is applied to the left-hand side by way of the coaxial connector 96 and the output is obtained from the coaxial connector 95 at the right-hand side.

We claim:

1. An RF connector comprising:

a center conductor portion, an outer conductor portion surrounding said center conductor and havings its longitudinal axis substantially parallel to the longitudinal axis of said center conductor;

dielectric material interposed between said center conductor and said outer conductor intermediate the ends thereof;

at least one current sensitive interrupting means surrounded by said outer conductor and connected electrically in series with said inner conductor;

said dielectric material contains at least two openings extending therethrough with the longitudinal axis of said openings being substantially parallel to the longitudinal axis of said center conductor and said outer conductor;

a first diode located within one of said openings and havings its anode lead extending out of one end thereof and connected to said center conductor and its cathode lead extending out of the other end thereof and connected to said outer conductor, and a second diode located within the other said opening and having its cathode lead extending out of one end thereof and connected to said center conductor and its anode lead extending out of the other end thereof and connected to said outer conductor.

2. An RF connector comprising:

a center conductor portion, an outer conductor portion surrounding said center conductor and havings its longitudinal axis substantially parallel to the longitudinal axis of said center conductor;

dielectric material interposed between said center conductor and said outer conductor intermediate the ends thereof;

at least one current sensitive interrupting means surrounded by said outer conductor and connected electrically in series with said inner conductor;

said dielectric material contains first, second, third and fourth openings extending therethrough from one end thereof to the other end thereof;

said openings having a longitudinal axis that is substantially parallel to said outer and inner conductors;

a first diode located within said first opening and having its anode lead extending from said other end and its cathode lead extending from said one end;

a second diode located within said second opening and havings its anode lead extending from said one end and its cathode lead extending from said other end;

said cathode lead of said second diode electrically coupled to said center conductor;

said anode lead of said first diode electrically coupled to said outer conductor; p1 said cathode lead of said first diode electrically coupled to said anode lead of said second diode;

a third diode located within said third opening and having its anode lead extending from said other end and its cathode lead extending from said one end; and a fourth diode located within said fourth opening and having its cathode lead extending from said other end and its anode lead extending from said one end;

said anode lead of said third diode electrically coupled to said center conductor;

said cathode lead of said fourth diode electrically coupled to said outer conductor;

said cathode lead of said third diode electrically connected to said anode lead of said fourth diode.

3. The RF connector according to claim 2 wherein said openings extending through said dielectric are substantially equally spaced along a radius located between said outer and inner conductors.

* * * * *